US011398703B2

(12) United States Patent
Su et al.

(10) Patent No.: US 11,398,703 B2
(45) Date of Patent: Jul. 26, 2022

(54) RADIO FREQUENCY CONNECTOR

(71) Applicants: SHENZHEN SUNWAY COMMUNICATION CO., LTD., Guangdong (CN); SHENZHEN SUNWAY PRECISION CONNECTOR CO., LTD., Guangdong (CN)

(72) Inventors: Yule Su, Guangdong (CN); Mickey Ge, Guangdong (CN); Ren-Chih Li, Guangdong (CN)

(73) Assignees: SHENZHEN SUNWAY COMMUNICATION CO., LTD., Guandong (CN); SHENZHEN SUNWAY PRECISION CONNECTOR CO., LTD., Guandong (CN)

( * ) Notice: Subject to any disclaimer, the term of this patent is extended or adjusted under 35 U.S.C. 154(b) by 80 days.

(21) Appl. No.: 16/769,455

(22) PCT Filed: Sep. 11, 2019

(86) PCT No.: PCT/CN2019/105251
§ 371 (c)(1),
(2) Date: Jun. 3, 2020

(87) PCT Pub. No.: WO2021/017107
PCT Pub. Date: Feb. 4, 2021

(65) Prior Publication Data

US 2021/0408728 A1 Dec. 30, 2021

(30) Foreign Application Priority Data

Jul. 26, 2019 (CN) ..... 201910681945.7

(51) Int. Cl.
*H01R 13/6581* (2011.01)
*H01R 12/71* (2011.01)
*H01R 13/6594* (2011.01)

(52) U.S. Cl.
CPC ..... *H01R 13/6581* (2013.01); *H01R 12/712* (2013.01); *H01R 13/6594* (2013.01); (Continued)

(58) Field of Classification Search
CPC ..... H01R 13/6581; H01R 12/712; H01R 13/6594; H01R 12/714; H01R 12/716; H01R 12/71
See application file for complete search history.

(56) References Cited

U.S. PATENT DOCUMENTS

2008/0305689 A1 12/2008 Zhang et al.

FOREIGN PATENT DOCUMENTS

CN 102270795 A 12/2011
CN 205565169 U 9/2016
(Continued)

OTHER PUBLICATIONS

Apr. 24, 2020 International Search Report issued in International Patent Application No. PCT/CN2019/105251.

*Primary Examiner* — Abdullah A Riyami
*Assistant Examiner* — Justin M Kratt
(74) *Attorney, Agent, or Firm* — Oliff PLC

(57) ABSTRACT

A radio frequency connector comprises a first base. The end face of one end of a first shielding frame contacts with a first external PCB. The end, close to the first external PCB, of the first shielding frame is in the shape of a complete and gapless ring. The first shielding frame disposed around the first base is complete and gapless and can realize 360° omnidirectional and dead zone-free shielding of a first terminal on the first base, so that the anti-interference
(Continued)

capacity of the radio frequency connector is effectively improved, and the electrical performance of the radio frequency connector is improved, accordingly.

6 Claims, 2 Drawing Sheets

(52) U.S. Cl.
CPC ..... *H01R 12/71* (2013.01); *H01R 12/714* (2013.01); *H01R 12/716* (2013.01)

(56) References Cited

FOREIGN PATENT DOCUMENTS

| | | | | | |
|---|---|---|---|---|---|
| CN | 106935995 | A | | 7/2017 | |
| CN | 107910677 | A | * | 4/2018 | ..... H01R 12/70 |
| CN | 107910677 | A | | 4/2018 | |
| CN | 108511997 | A | | 9/2018 | |

* cited by examiner

RADIO FREQUENCY CONNECTOR

TECHNICAL FIELD

The invention relates to the technical field of connectors, in particular to a radio frequency connector.

DESCRIPTION OF RELATED ART

Radio frequency connectors typically have a female end and a male end which are plugged and matched with each other, wherein the female end comprises a female base and a female terminal disposed on the female base, the male end comprises a male base and a male terminal disposed on the male base, and the male terminal is matched with the female terminal.

Due to the lack of a shielding structure of existing radio frequency connectors, signals transmitted by the male and female terminals are often disturbed by external factors, thus resulting in poor electrical performance of the radio frequency connectors.

BRIEF SUMMARY OF THE INVENTION

The technical issue to be settled by the invention is to provide a radio frequency connector with good shielding performance.

The technical solution adopted by the invention to settle the aforesaid technical issue is as follows: a radio frequency connector comprises a first base, wherein a first shielding frame is disposed around the first base, the end face of one end of the first shielding frame contacts with a first external printed circuit board (PCB), and the end, close to the first external PCB, of the first shielding frame is in the shape of a complete and gapless ring.

The invention has the following beneficial effects: the first shielding frame disposed around the first base is complete and gapless and can realize 360° omnidirectional and dead zone-free shielding of a first terminal on the first base, so that the anti-interference capacity of the radio frequency connector is effectively improved, and the electrical performance of the radio frequency connector is improved, accordingly.

REFERENCE SIGNS

Figure 1:
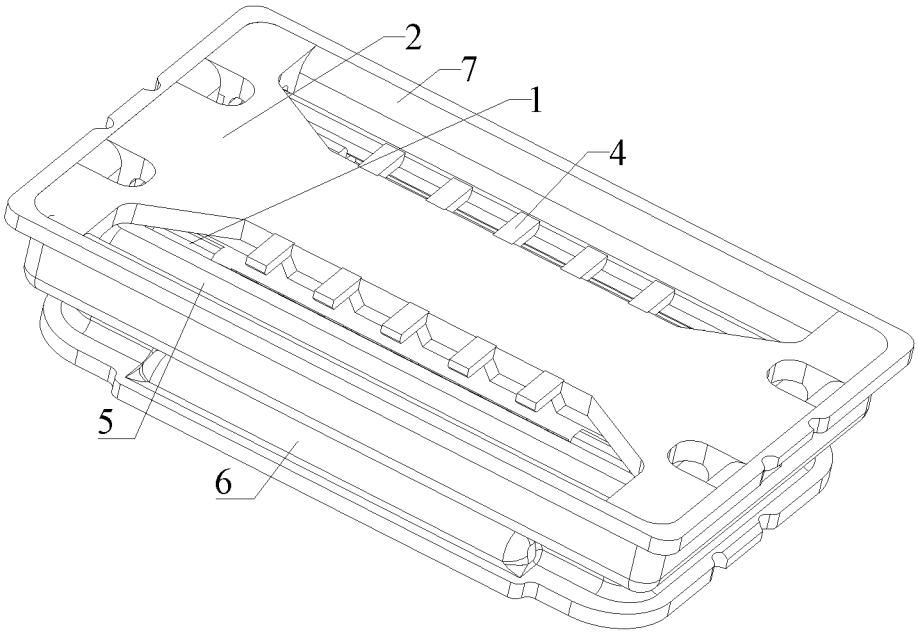
FIG. 1 is an overall structural view of a radio frequency connector in Embodiment 1 of the invention.

1, first base;
2, second base;
3, first terminal;
4, second terminal;
5, first shielding frame;
6, convex encapsulation part;
7, second shielding frame.

DETAILED DESCRIPTION OF THE INVENTION

The technical contents, purposes and effects of the invention are expounded below in conjunction with the implementations and accompanying drawings.

Referring to FIG. 1 to FIG. 4, a radio frequency connector comprises a first base 1, wherein a first shielding frame 5 is disposed around the first base 1, the end face of one end of the first shielding frame 5 contacts with a first external PCB, and the end, close to the first external PCB, of the first shielding frame 5 is in the shape of a complete and gapless ring.

From the above description, the invention has the following beneficial effects: the first shielding frame 5 disposed around the first base 1 is complete and gapless and can realize 360° omnidirectional and dead zone-free shielding, so that the anti-interference capacity of the radio frequency connector is effectively improved, and the electrical performance of the radio frequency connector is improved, accordingly.

Furthermore, at least one part of the end face of the first shielding frame 5 is welded to the first external PCB.

From the above description, the first shielding frame 5 is welded to the first external PCB, so that the first shielding frame 5 can be grounded steadily, thus guaranteeing the shielding performance of the radio frequency connector.

Furthermore, the radio frequency connector further comprises a second base 2 which is plugged and matched with the first base 1, wherein a second shielding frame 7 is disposed around the second base body 2, and at least one part of the first shielding frame 5 is located in the second shielding frame 7.

Furthermore, the end face of one end of the second shielding frame 7 contacts with a second external PCB, and the end, close to the second external PCB, of the second shielding frame 7 is in the shape of a complete and gapless ring.

From the above description, the second shielding frame 7 disposed around the second base 2 is complete and gapless and can realize 360° omnidirectional and dead zone-free shielding of a second terminal 4 on the second base 2, so that the anti-interference performance and electrical performance of the radio frequency connector are further improved.

Furthermore, at least one part of the end face of the second shielding frame 7 is welded to the second external PCB.

From the above description, the second shielding frame 7 is welded to the second external PCB, so that the second shielding frame 7 can be grounded steadily, thus guaranteeing the shielding performance of the radio frequency connector.

Furthermore, a first terminal 3 is disposed on the first base 1, and the first shielding frame 5 has convex encapsulation parts 6 for covering weld legs of the first terminal 3. From the above description, the convex encapsulation parts 6 can decrease the size of the first base 1 on the premise of ensuring omnidirectional shielding of the first terminal 3, so that the installation space of the radio frequency connector is reduced, and the radio frequency connector can adapt to more installation environments.

Furthermore, gaps are reserved between the inner walls of the convex encapsulation parts 6 and the weld legs of the first terminal 3.

Embodiment 1

Figure 2:
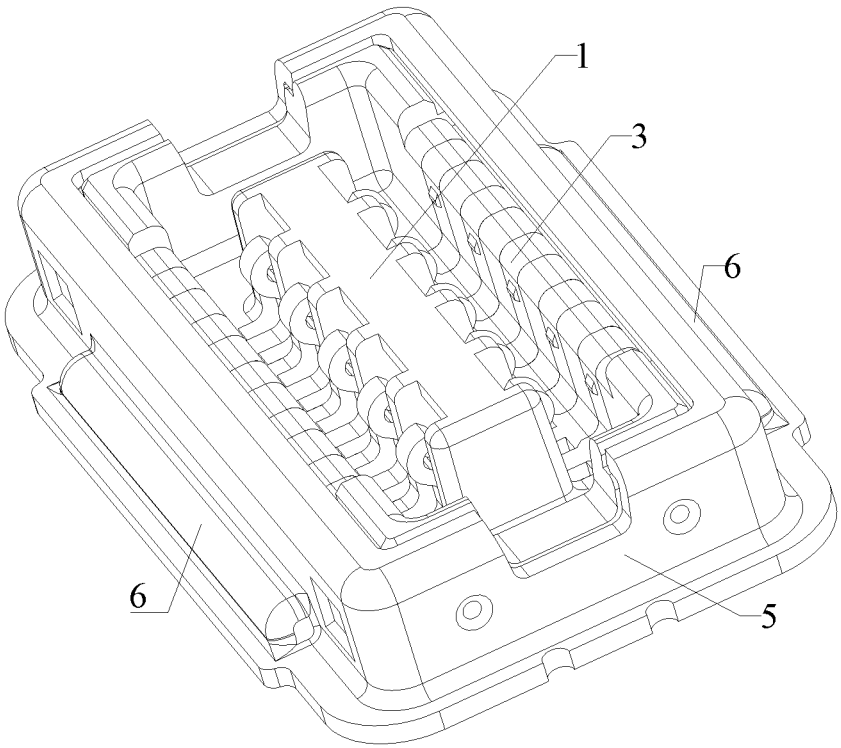
FIG. 2 is a structural view of a female end of the radio frequency connector in Embodiment 1 of the invention.
Figure 3:
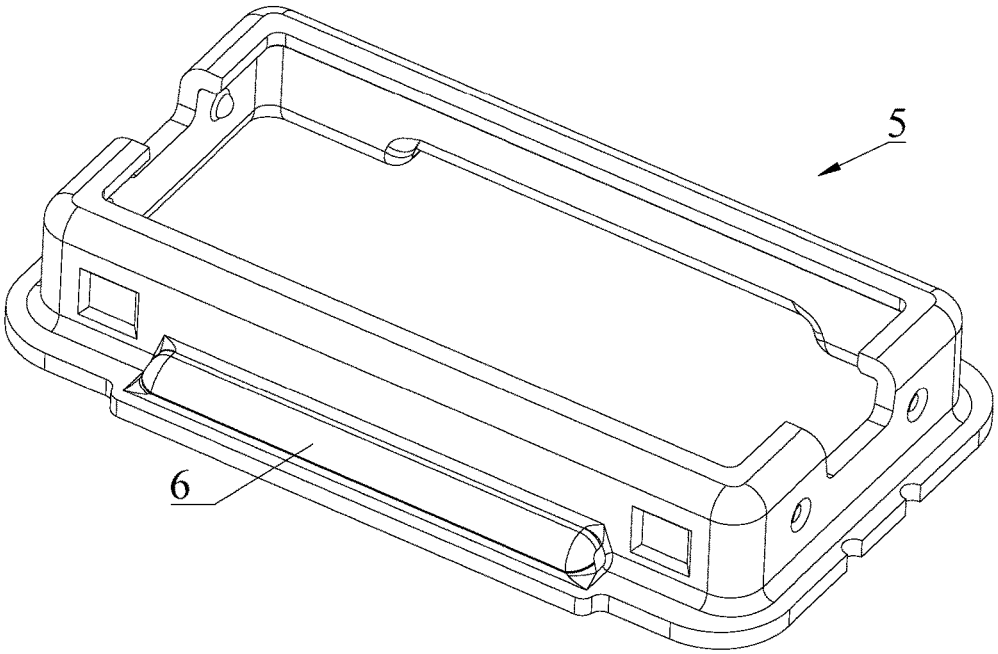
FIG. 3 is a structural view of a first shielding frame of the radio frequency connector in Embodiment 1 of the invention.

Referring to FIG. 1 to FIG. 4, Embodiment 1 of the invention is as follows: referring to FIG. 1 and FIG. 2, a radio frequency connector comprises a first base 1 and a second base 2, wherein a first terminal 3 is disposed on the first base 1, a second terminal 4 plugged with the first terminal 3 is disposed on the second base 2, and the first base 1 is plugged and matched with the second base 2 through the cooperation of the first terminal and the second terminal.

In this embodiment, the first base 1 is a female base, and the first terminal 3 is a female terminal; and correspondingly, the second base 2 is a male base, and the second terminal 4 is a male terminal. Or, in other embodiments, the first base 1 may be a male base. A female connector end constituted by the first base 1 and a first shielding frame 5 may be an integral structure formed by inserts through an injection molding process, or an assembled structure formed through later assembly and connection. A male connector end constituted by the second base 2 and a second shielding frame 7 is formed in a similar way.

Referring to FIG. 1 to FIG. 4, a first shielding frame 5 is disposed around the first base 1, the end face 8 of one end of the first shielding frame 5 contacts with a first external PCB, and the end, close to the first external PCB, of the first shielding frame 5 is in the shape of a complete and gapless ring. The end face 8 of one end of the first shielding frame 5 contacts with the first external PCB, so that a seam between the first shielding frame 5 and the first external PCB is avoided, and the risk of signal interference and leakage is drastically lowered. Ideally, the height of the first shielding frame 5 is equal to that of the first base 1. In fact, under the influence of various factors such as machining conditions and operating environments, the height of the first shielding frame 5 may be slightly smaller than that of the first base 1. Optionally, the bottom surface of the first shielding frame 5 is coplanar with the bottom surfaces of weld legs of the first terminal 3. First shielding frame 5 also includes an upright exterior face 9 that is perpendicular to end face 8. Convex encapsulation part 6 is disposed between end face 8 and upright exterior face 9.

Furthermore, at least one part of the end face of the first shielding frame 5 is welded to the first external PCB, so that the first shielding frame 5 is made conductive with the first external PCB, and the connection stability of the female end and the first external PCB is improved. Because the first shielding frame 5 is in the shape of a complete ring, a conduction region between the first shielding frame 5 and the first external PCB should be also in the shape of a complete ring theoretically. In fact, due to the constraints of the installation environment or other factors, the conduction region between the first shielding frame 5 and the first external PCB may not be a complete ring, that is, the end face, close to the first external PCB, of the first shielding frame 5 is conductive with a local part of the first external PCB.

As shown in FIG. 1, a second shielding frame 7 is disposed around the second base 2, at least one part of the first shielding frame 5 is located in the second shielding frame 7, the end face of one end of the second shielding frame 7 contacts with a second external PCB, and the end, close to the second external PCB, of the second shielding frame 7 is in the shape of a complete and gapless ring. The second shielding frame 7 can realize 360° omnidirectional and dead zone-free shielding of the second terminal 4.

Furthermore, at least one part of the end face of the second shielding frame 7 is welded to the second external PCB. In this way, double-layer 360° omnidirectional and dead zone-free shielding of the radio frequency connector can be realized by the first shielding layer and the second shielding layer, and a better enclosed environment is created for the first terminal and the second terminal.

Figure 4:
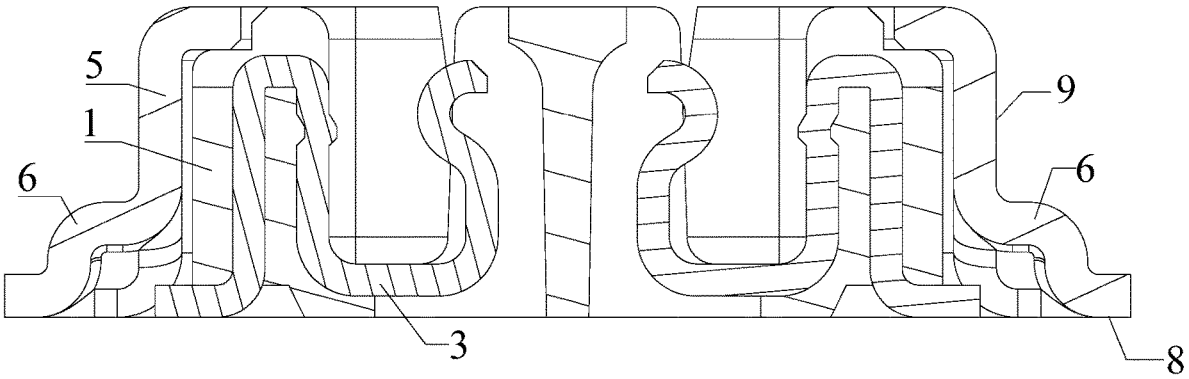
FIG. 4 is a sectional view of the female end of the radio frequency connector in Embodiment 1 of the invention.

Referring to FIG. 2 and FIG. 4, to reduce the installation space of the radio frequency connector, the first shielding frame 5 has convex encapsulation parts 6 for covering the weld legs of the first terminal 3, and gaps are reserved between the inner walls of the convex encapsulation parts 6 and the weld legs of the first terminal 3. Similarly, the second shielding frame 7 also has convex encapsulation parts 6. As can be seen in FIG. 4, convex encapsulation parts 6 are disposed between the end of the first shielding frame 5 and the first base 1.

Optionally, the first shielding frame 5 is directly conductive with the second shielding frame 7 in the manner of point contact, surface contact, gaps or the like, or is indirectly conductive with the second shielding frame 7 by means of a conducting part or the like. A better enclosed environment can be created by the conduction of the first shielding frame and the second shielding frame.

According to the radio frequency connector provided by the invention, the complete and gapless shielding frames are disposed around the bases to realize 360° omnidirectional and dead zone-free shielding of the radio frequency connector, so that the anti-interference performance (shielding performance) of the radio frequency connector is effectively improved, and the electrical performance of the radio frequency connector is improved, accordingly.

The above embodiments are merely illustrative ones of the invention, and are not intended to limit the patent scope of the invention. All equivalent transformations made on the basis of the contents of the specification and accompanying drawings, or direct or indirect applications to relating technical fields should also fall within the patent protection scope of the invention.

The invention claimed is:

1. A radio frequency connector, comprising:

a first base;

a first terminal disposed on the first base;

a first shielding frame disposed around the first base;

an end face of an end of the first shielding frame configured to contact a first external printed circuit board (PCB), and the end of the first shielding frame being in a shape of a complete and gapless ring;

an upright exterior face of the first shielding frame that is perpendicular to the end face; and a convex encapsulation part covering a weld leg of the first terminal, the convex encapsulation part being disposed between the end face and the upright exterior face of the first shielding frame.

2. The radio frequency connector according to claim 1, wherein at least one part of the end face of the first shielding frame is welded to the first external PCB.

3. The radio frequency connector according to claim 1, further comprising a second base which is plugged and matched with the first base, wherein a second shielding frame is disposed around the second base, and at least one part of the first shielding frame is located in the second shielding frame.

4. The radio frequency connector according to claim 3, wherein an end face of an end of the second shielding frame is configured to contact a second external PCB, and the end of the second shielding frame is in the shape of the complete and gapless ring.

5. The radio frequency connector according to claim 4, wherein at least one part of the end face of the second shielding frame is welded to the second external PCB.

6. The radio frequency connector according to claim 1, wherein gaps are provided between inner walls of the convex encapsulation parts and the weld legs of the first terminal.

* * * * *